US007237483B2

(12) United States Patent
Schäfer et al.

(10) Patent No.: US 7,237,483 B2
(45) Date of Patent: Jul. 3, 2007

(54) DEVICE FOR GUIDING A DRESSING ON A CYLINDER OF A PRINTING PRESS

(75) Inventors: Karl Robert Schäfer, Rimpar (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 173 days.

(21) Appl. No.: 10/524,425

(22) PCT Filed: Aug. 7, 2003

(86) PCT No.: PCT/DE03/02653

§ 371 (c)(1),
(2), (4) Date: Feb. 15, 2005

(87) PCT Pub. No.: WO2004/020199

PCT Pub. Date: Mar. 11, 2004

(65) Prior Publication Data

US 2005/0252400 A1 Nov. 17, 2005

(30) Foreign Application Priority Data

Aug. 21, 2002 (DE) ..... 102 38 179

(51) Int. Cl.
*B41F 27/12* (2006.01)

(52) U.S. Cl. ..... 101/477; 101/415.1

(58) Field of Classification Search ..... 101/477, 101/415.1, 378, 382.1, 216, 217
See application file for complete search history.

(56) References Cited

U.S. PATENT DOCUMENTS

| | | | | |
|---|---|---|---|---|
| 5,309,832 | A | 5/1994 | Merkel et al. | |
| 5,617,792 | A | 4/1997 | Rau et al. | |
| 5,709,150 | A | 1/1998 | Durr et al. | |
| 6,199,280 | B1 | 3/2001 | Schneider et al. | |
| 6,439,117 | B1 | 8/2002 | Dumais et al. | |
| 6,588,341 | B1 * | 7/2003 | Hieronymus et al. | 101/477 |
| 6,792,860 | B2 | 9/2004 | Schroder et al. | |
| 2005/0000381 | A1 | 1/2005 | Schneider et al. | |
| 2005/0005793 | A1 | 1/2005 | Schafer et al. | |

FOREIGN PATENT DOCUMENTS

| | | |
|---|---|---|
| DE | 44 24 931 C2 | 8/1996 |
| DE | 196 39 800 C1 | 2/1998 |
| DE | 197 19 559 A1 | 11/1998 |
| DE | 100 01 319 A1 | 7/2001 |
| DE | 101 20 134 A1 | 11/2001 |

(Continued)

*Primary Examiner*—Leslie J. Evanisko
(74) *Attorney, Agent, or Firm*—Jones, Tullar & Cooper P.C.

(57) ABSTRACT

A dressing is guided onto a cylinder of a printing machine. At least one roller element is used to accomplish this dressing guidance. A support, which includes spaced first and second ends, is provided. The first end of the support is connected to a cross-piece that is running along parallel to an axis of rotation of the cylinder. The at least one roller element is situated on the second end of this support. The support is an elastically flexible body. An actuator is arranged between the cross-piece and the support. The actuator is operable to move the roller toward or away from the cylinder by flexing the elastic support.

29 Claims, 3 Drawing Sheets

FOREIGN PATENT DOCUMENTS

| | | | |
|---|---|---|---|
| EP | 0 531 748 | A1 | 3/1993 |
| EP | 0 712 725 | A2 | 5/1996 |
| WO | WO 01/87613 | A1 | 11/2001 |
| WO | WO 03/031179 | A2 | 4/2003 |
| WO | WO 03/031179 | A3 | 4/2003 |
| WO | WO 03/047863 | A1 | 6/2003 |

* cited by examiner

DEVICE FOR GUIDING A DRESSING ON A CYLINDER OF A PRINTING PRESS

CROSS-REFERENCE TO RELATED APPLICATIONS

This U.S. patent application is the U.S. national phase, under 35 USC 371, of PCT/DE2003/002653, filed Aug. 7, 2003; published as WO 2004/020199 A2 on Mar. 11, 2004, and claiming priority to DE 102 38 179.8 filed Aug. 21, 2002, the disclosures of which are expressly incorporated herein by reference.

FIELD OF THE INVENTION

The present invention is directed a device for guiding a dressing on a cylinder of a printing press. At least one roller is used to guide the dressing. The roller is situated at one end of a support and can be moved toward and away from a cylinder which will receive the dressing.

BACKGROUND OF THE INVENTION

A device for mounting flexible printing plates is known from DE 197 19 559 A1. A pressure roller is arranged on a holder that is embodied, for example, as a leaf spring. The holder is connected with an insertion slider. The insertion slider can be placed against a forme cylinder by linear movement and, in the process, introduces an end of the printing plate into a fastening slit which is cut into the forme cylinder.

A device for use in pressing a dressing against a cylinder of a printing press with the aid of several rolling elements, in particular with the aid of several rollers, which rollers are arranged along the cylinder, is known from EP 0 712 725 A2.

WO 01/87613 A1 describes a method and several embodiments of a device for pressing a dressing against a cylinder of a printing press. Several rollers are pressed against the cylinder by an actuating device during mounting and dismounting of a dressing. The actuating device can be configured as a reversibly deformable hollow body, such as, for example, a tube, which deformable hollow body can be charged with a pressure medium. By charging the hollow body with the pressure medium, a rigid roller support, which is substantially embodied in the form of a die, is pressed against the cylinder in opposition to the force exerted by a spring. In one embodiment of this prior device, the roller support is embodied as a rocker or as a one-armed lever. In addition to the first rollers, which are spaced apart from each other and which can be placed against the cylinder for mounting fresh dressings, another embodiment of this prior device provides a plurality of second rollers, which can be placed against the cylinder for use during the dismounting of dressings. Two actuating devices, which can be operated independently of each other, can be provided for placing the first and second rollers against the cylinder.

SUMMARY OF THE INVENTION

The object of the present invention is directed to providing a device for guiding a dressing on a cylinder of a printing press.

In accordance with the invention, this object is attained by the provision of at least one rolling element or roller that is engageable with a dressing to be applied to a printing press. The roller is situated at a first end of a support whose second end is secured to a holder that is spaced from the cylinder.

An actuating device is positioned between the support and the holder intermediate its ends. That actuating device can be operated to move the roller toward and away from the surface of the cylinder. A plurality of supports, each with one roller, can be positioned side-by-side along the holder. Each such support has its own actuating device and can be moved independently of other such supports.

The advantages to be gained by the present invention consist, in particular, in that an embodiment of the support of the rolling element as an elastically bendable body results in it being able to structure the device as being very flat, and therefore space-saving. Such a flat, space-saving structure is very advantageous in connection with the installation conditions in a printing press. The device in accordance with the present invention is resistant to dirt and is more rugged than an arrangement with a support which is attached to a hinge, for example. Such a hinge, at the intended installation location, must be protected against soiling, such as, for example, by ink splatters or by dust, for interference-free functioning, which soil protection entails an additional outlay. Moreover, in the course of interaction of the support with the actuating device, which is acting on the support, no separate spring element is required for returning the support into its initial position after an operation of the actuating device. Because of its configuration as an elastically bendable body, the support has an inherent spring-back property. In comparison with a device in accordance with the prior art, the device for guiding dressings on a cylinder of a printing machine, in accordance with the present invention, clearly requires fewer components for mounting a dressing on a cylinder. In particular, the present device requires no insertion sliders, which introduce an end of the dressing into a fastening slit cut into the forme cylinder.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
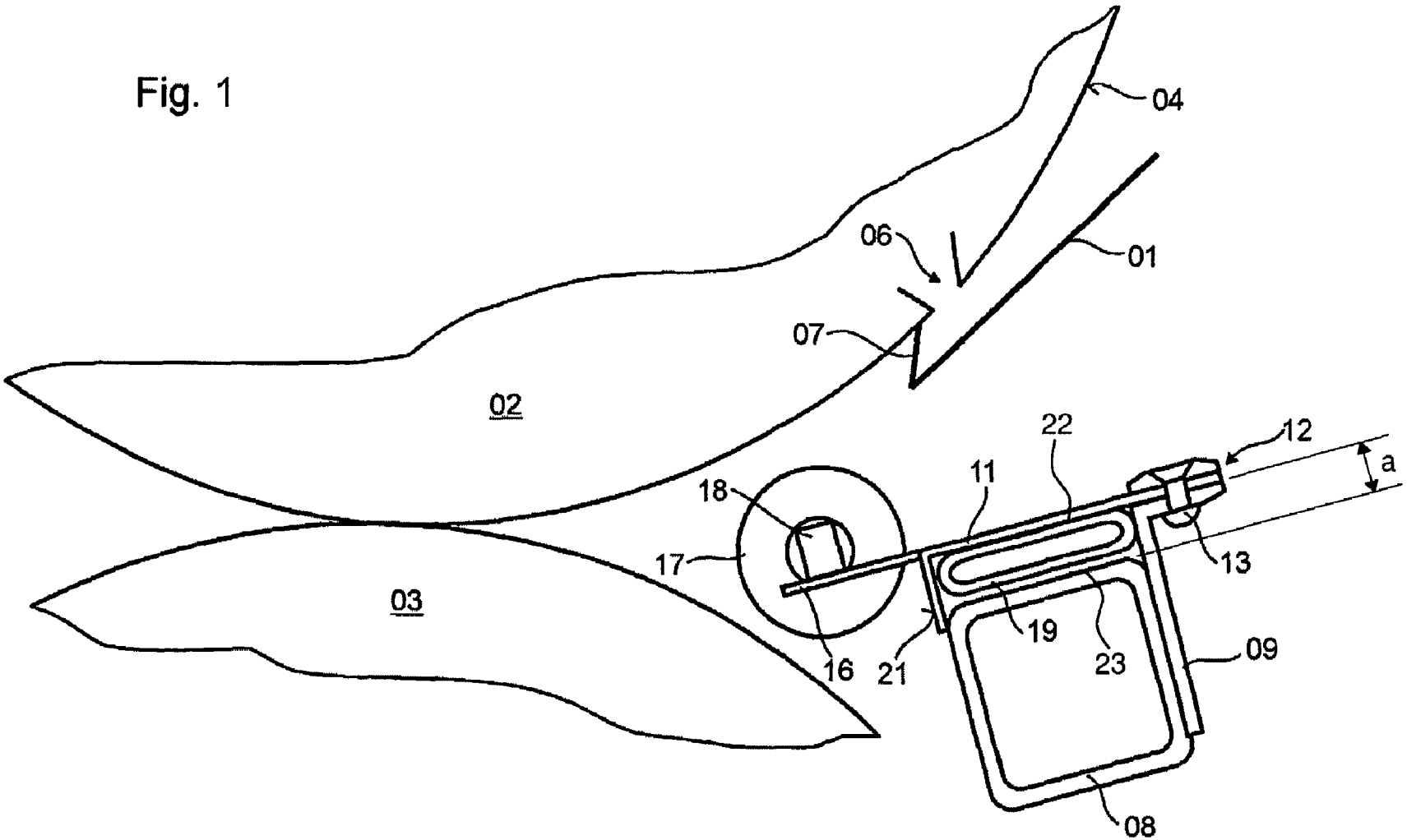
FIG. 1, a side elevation view of a device for pressing a dressing against a cylinder in accordance with the present invention in a state where the device is removed from, or is moved away from the cylinder, in FIG. 2, a side elevation view of the device for pressing a dressing against a cylinder in a state where the device is placed against the cylinder, and in FIG. 3 a perspective view of the device for pressing a dressing against a cylinder and showing several individual supports and rolling elements arranged side-by-side in the axial direction of the cross arm.

A forme cylinder 02, on which at least one dressing 01, for example at least one preferably flexible printing forme 01, can be placed, rolls off against a counter-pressure cylinder 03, which may be, for example, a transfer cylinder 03, in a printing press, such as, for example, a web-fed rotary offset printing press. On its surface area 04, the forme cylinder 02 preferably has at least one slit-shaped opening 06 that extends longitudinally with respect to the cylinder 01, and in which opening 06 a beveled edge 07, that is placed on one end of the dressing 01, can be suspended, preferably in a positively connected manner.

Figure 2:
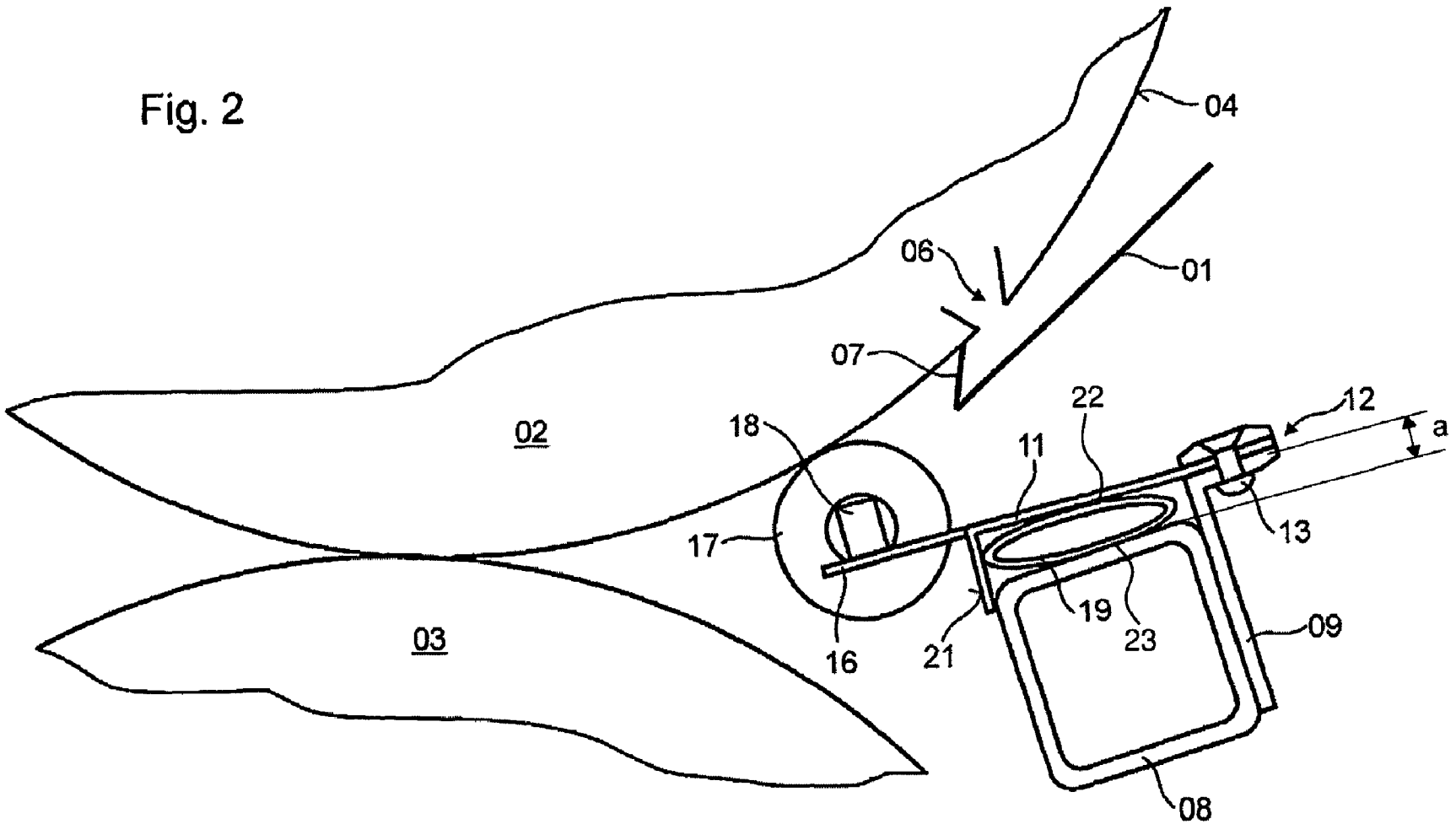
Figure 3:
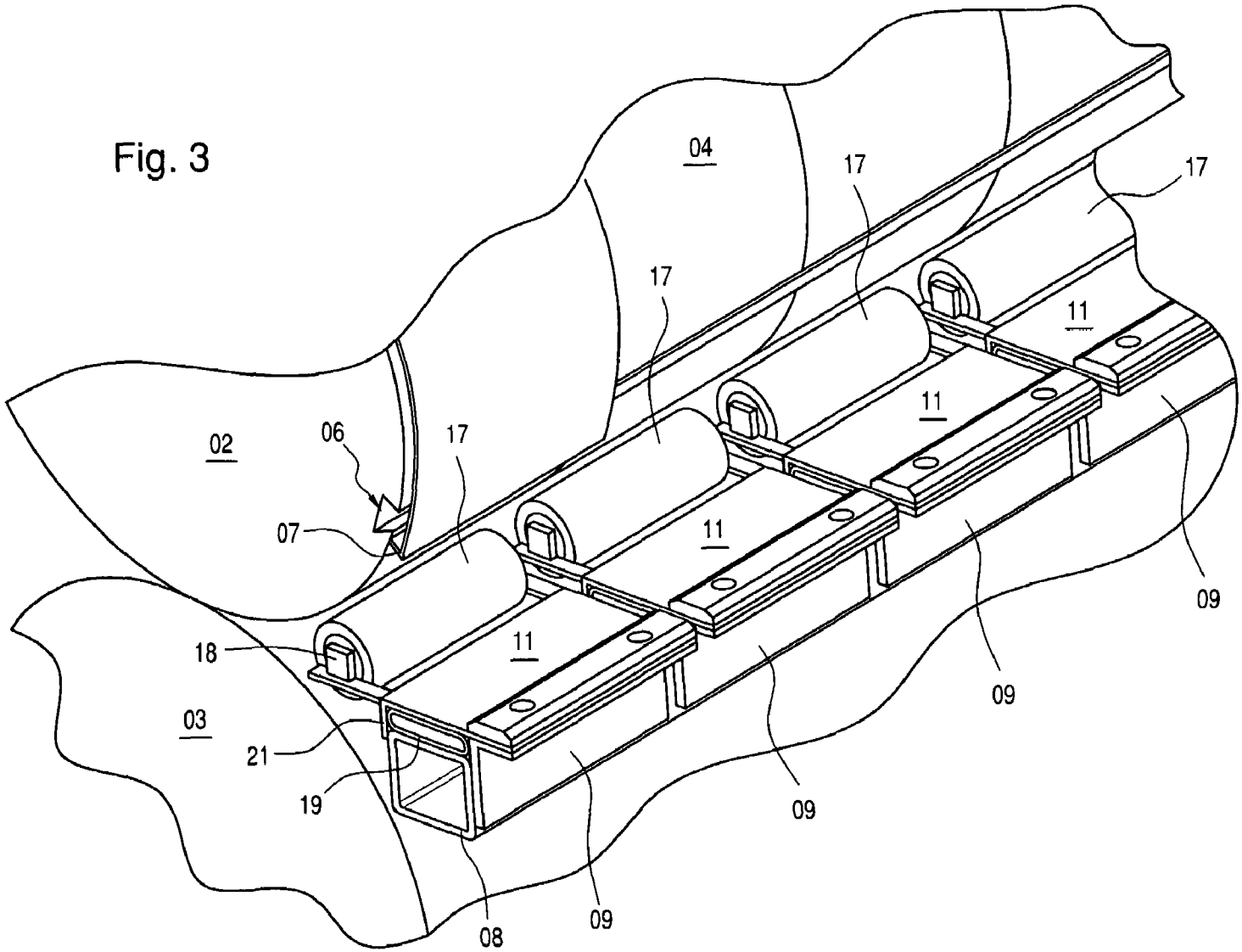

A holder 08 for at least one support 11, typically for a plurality of supports 11, is provided, and is spaced apart from the cylinder 02, as seen in FIGS. 1, 2 and 3. In the preferred embodiment of the present invention, a cross arm 08 which can be, for example, a rigid hollow profile of square cross section and which extends along in the axial directions of these cylinders 02, 03, is preferably located in an area or space in front of, and between the forme cylinder 02 and the counter-pressure cylinder 03. Holder 08 is thus situated in the gap or in the space delimited by the surface areas of the cylinders 02, 03, as seen in FIGS. 1, 2 and 3. At least one support 11 is attached, either directly, or by the inclusion of a connecting piece 09 which connecting piece 09 can be, for example, an L-shaped strip, to this holder 08, that is preferably configured as a cross arm 08. Support 11 has a first end 12, with which the support 11 is connected to the cross arm 08 or to the connecting piece 09 that is secured to the cross arm 08. The connection of the first end 12 of the support 11 to the holder 08 or to the connecting piece 09 is preferably accomplished by the use of a connecting element 13, which can be a screw 13 or a rivet 13. In this way, the first end 12 of the support 11 is not connected hingedly, but instead is connected rigidly with the holder 08, and, in particular, is clamped to the holder 08. The support 11 has a face 22, and the holder 08 has a face 23, wherein both faces 22, 23 are facing each other, as seen in FIGS. 1 and 2. The two opposing faces 22, 23 are arranged spaced apart at a spacing "a" from each other.

A rotatably supported rolling element 17 or roller 17 is positioned on a second end 16 of support 11, which support second end 16 is located opposite the first end 12 of the support 11. When the rolling element 17 is placed against the forme cylinder 02, it can roll off on the surface area 04 of the forme cylinder 02, or on a dressing 01 resting on the surface area 04 of the forme cylinder 02, as seen in FIG. 2, because of which rolling contact, a beveled edge 07, that is placed on one end of the dressing 01, is pressed into an opening 06 in the surface area 04 of the cylinder 02. A dressing 01 is accordingly pressed against the surface area 04 of the forme cylinder 02. Thus, a rotating shaft 18 of the rolling element 17 extends along the forme cylinder 02 in an axial direction of the cylinder 02. Preferably, the rolling element 17 is configured as a roller 17 and, in the preferred embodiment, is suitable for introducing a beveled edge 07 at one end of the dressing 01 into an opening 06 in the cylinder 02.

The support 11 itself is an elastically bendable, and thus is a reversibly deformable body, which body is preferably embodied in the shape of a blade. Thus, the support 11 can be a resilient sheet metal piece 11, which is fixedly clamped at its first end 12, as seen in FIGS. 1 and 2.

An actuating device 19 is also provided, as seen in FIGS. 1 and 2, between holder 08 and support 11, wherein the actuating device 19 is preferably embodied as a reversibly deformable hollow body 19, for example as a tube 19, which can be charged with a pressure medium. When operated, such as, for example, when being charged with a pressure medium, the actuating device 19 acts on its one side on the support 11 and on its other on the holder 18. This is because the actuating means 19 is supported by, and between, the facing surfaces 22, 23 of the holder 08 and the support 11 respectively, as seen in FIG. 2. By operating or inflating the actuating device 19, the second end 16 of the support 11 is deflected in the direction toward the forme cylinder 02 because of the elastic bending of the support 11, and the rolling element 17 or roller 17 is placed against the cylinder 02, as seen in FIG. 2. The holder 08 remains stationary, at rest, in relation to the cylinder 02, while the second end 16 of the support 11 performs a pivoting movement directed toward the cylinder 02, because of which pivoting movement of support 11 second end 16 toward cylinder 02 the spacing "a" between the faces 22, 23 is increased. At the termination of the operation or inflation of the actuating device 19, the support 11 returns into its original position because of its elasticity, i.e. because of its resilient properties. As a result, the rolling element 17 is again moved away from the surface area 04 of the forme cylinder 02, or from the surface of a dressing 01 resting on the surface area 04 of the forme cylinder 02. Rolling element on roller 17 is thus moved out of contact with the forme cylinder 02 or dressing 01.

If, as represented in FIG. 1, the actuating device 19 is installed between the support 11 and the cross arm 08, it is advantageous, for example, to form or to attach a strip 21 on the support 11, which strip 21 protects the actuating device 19 from inadvertently slipping out of, or from being removed from, its place of installation between cross arm 08 and support 11.

Thus, FIGS. 1 and 2 show, by way of example, the arrangement of a device for guiding, and in particular, for pressing, a dressing 01 on a cylinder 02 of a printing press, in accordance with the present invention, in two different states of operation. In FIG. 1 the device is shown in the operating state with a rolling element 17 moved away, and in FIG. 2 the device is shown in the operating state with a rolling element 17 brought into contact. The device, in accordance with the present invention can be used, for example, for mounting a dressing 01 on a cylinder 02.

For some applications, for example in connection with an arrangement of several printing formes arranged side-by-side in the axial direction on the surface area 04 of the forme cylinder 02, it is advantageous to arrange several individual supports 11 side-by-side in the axial direction on the cross arm 08 as seen in FIG. 3. Each individual support 08 is provided with at least one rolling element 17. The several individual supports 11 can each be put into, and taken out of contact with the cylinder 02 independently of each other, either individually or in groups of supports 11 by the appropriate operation of the separate actuating devices 19 assigned to the individual supports 11. Thus, it is possible to respectively use a single rolling element 11, or to use a group of rolling elements 11 selectively for pressing a defined printing forme or dressing 01, selected from a plurality of axially spaced printing formes or dressings 01 on the face of a forme cylinder 02.

While a preferred embodiment of a device for guiding a dressing on a cylinder of a printing machine, in accordance with the present invention has been set forth fully and completely above, it will be apparent to one of skill in the art that various changes in, for example, the overall sizes of the cylinders, the source of supply for the fluid under pressure, and the like could be made without departing from the true spirit and scope of the present invention which is accordingly to be limited only by the following claims.

What is claimed is:

1. A device for guiding a dressing on a cylinder of a printing press comprising:

at least one holder positioned spaced from said cylinder;

a plurality of supports, each of said supports having a first end and a second end, said plurality of supports being arranged side-by-side on said at least one holder;

means connecting said first end of each said support to said at least one holder;

at least one rolling element supported on said second end of each said support; and an actuating means between each of said plurality of supports and said at least one holder intermediate said first and second ends of each said support, each said actuating means being operable independently to move its associated one of said rolling elements toward and away said cylinder.

2. The device of claim 1 wherein each of said plurality of supports is an elastically bendable body.

3. The device of claim 2 wherein each said actuating means effects an elastic bending of each said elastically bendable body.

4. The device of claim 2 wherein said second end of each of said plurality of supports is pivotably movable by each said actuating means toward said cylinder.

5. The device of claim 1 wherein each of said plurality of supports is a resilient sheet metal piece.

6. The device of claim 1 wherein each said rolling element is adapted to guide a beveled edge of one end of the dressing into an opening in said cylinder.

7. The device of claim 1 wherein each of said plurality of supports has a support face and said holder has a holder face, each said support face and said holder face being arranged facing each other at a spacing distance.

8. The device of claim 7 wherein each said actuating means is supported by said support face and said holder face and is operable to increase said spacing distance.

9. The device of claim 1 wherein said holder is fixed in place relative to the cylinder.

10. The device of claim 1 wherein each said actuating means is a reversibly deformable hollow body adapted to be charged with a medium under pressure.

11. The device of claim 10 wherein each said actuating means is a tube.

12. The device of claim 1 wherein each said support is a blade.

13. The device of claim 1 wherein said first end of each of said plurality of supports is rigidly secured to said holder.

14. The device of claim 1 wherein said holder is a cross arm extending transversely to said cylinder.

15. The device of claim 1 wherein each said rolling element is a roller.

16. A device for guiding a dressing on a cylinder of a printing press comprising:

a holder positioned spaced apart from said cylinder;

a support having a first end and a second end, said support first end being rigidly connected to said holder, said support being an elastically bendable body having an inherent spring-back property;

at least one rolling element supported on said second end of said support; and an actuating means between said support and said holder intermediate said first and second ends of said support.

17. The device of claim 16 wherein said support is a resilient sheet metal piece.

18. The device of claim 16 wherein said actuating means effects an elastic bending of said elastically bendable body.

19. The device of claim 16 wherein said second end of said support is pivotably movable by said actuating means toward said cylinder.

20. The device of claim 16 wherein said rolling element is adapted to guide a beveled edge of one end of the dressing into an opening in said cylinder.

21. The device of claim 16 wherein said support has a support face and said holder has a holder face, said support face and said holder face being arranged facing each other at a spacing distance.

22. The device of claim 21 wherein said actuating means is supported by said support face and said holder face and is operable to increase said spacing distance.

23. The device of claim 16 wherein said holder is fixed in place relative to the cylinder.

24. The device of claim 16 wherein said actuating means is a reversibly deformable hollow body adapted to be charged with a medium under pressure.

25. The device of claim 24 wherein said actuating means is a tube.

26. The device of claim 16 wherein said support is a blade.

27. The device of claim 16 wherein said holder is a cross arm extending transversely to said cylinder.

28. The device of claim 16 wherein said rolling element is a roller.

29. The device of claim 16 further including a plurality of said supports each with one of said rolling elements, said plurality of supports being arranged side-by-side on said holder, each said support including a separate one of said actuating means, said plurality of rolling elements being positionable against or away from said cylinder independently.

* * * * *